US005532800A

United States Patent [19]

Saito

[11] Patent Number: 5,532,800

[45] Date of Patent: Jul. 2, 1996

[54] SEPARATING APPARATUS AND ELECTROPHOTOGRAPHIC IMAGE FORMING APPARATUS USING THE SAME

[75] Inventor: Hironobu Saito, Yokohama, Japan

[73] Assignee: Canon Kabushiki Kaisha, Tokyo, Japan

[21] Appl. No.: 490,132

[22] Filed: Jun. 14, 1995

[30] Foreign Application Priority Data

Jun. 16, 1994 [JP] Japan ..... 6-156420
May 23, 1995 [JP] Japan ..... 7-123909

[51] Int. Cl.[6] ..... G03G 15/08

[52] U.S. Cl. ..... 355/245; 355/298; 118/603; 209/38

[58] Field of Search ..... 355/245, 251, 355/298; 118/653, 603; 209/38

[56] References Cited

U.S. PATENT DOCUMENTS 4,389,968 6/1983 Satomura ..... 118/603 X 5,455,666 10/1995 Saito et al. ..... 355/298

*Primary Examiner*—Joan H. Pendegrass

*Attorney, Agent, or Firm*—Fitzpatrick, Cella, Harper & Scinto

[57] ABSTRACT

The invention provides a separating apparatus for removing foreign matters from magnetic toner, the separating apparatus being used in an electrophotographic image forming apparatus. The separating apparatus comprises a filter having openings for allowing passage of the magnetic toner, a magnetic field generating means for generating a magnetic field for attracting the magnetic toner and causing it to pass through the filter, and a magnetic force decreasing means for decreasing a magnetic force generated by the magnetic field generating means to lessen the magnetic field for attracting the magnetic toner and causing it to pass through the filter.

38 Claims, 9 Drawing Sheets

SEPARATING APPARATUS AND ELECTROPHOTOGRAPHIC IMAGE FORMING APPARATUS USING THE SAME

BACKGROUND OF THE INVENTION

Field of the Invention

The present invention relates to a separating apparatus for to an electrophotographic image forming apparatus utilizing an electrophotographic image forming process, and an electrophotographic image forming apparatus using such a separating apparatus.

The term "separating apparatus" used herein means an apparatus for removing foreign matter from toner used in the electrophotographic image forming process. The toner from which foreign matter has been removed can be reused in the electrophotographic image forming process.

The term "electrophotographic image forming apparatus" means an apparatus for forming an image on a recording medium by the electrophotographic image forming process, and includes an electrophotographic copying machine, electrophotograph facsimile equipment, an electrophotographic printer (such as a laser printer or an LED printer), or the like.

DESCRIPTION OF THE RELATED ART

In an electrophotographic image forming apparatus, it has recently been proposed to collect toner used for formation of an image, remove any foreign matter from the collected toner, and reuse the toner separated from the foreign matter in the formation of an image. One example of such proposals is that the magnetic toner removed from an electrophotographic photosensitive member is passed through a mesh filter to separate, from the toner, various foreign matters (e.g., paper powder, dust and the like) mixed with the toner in the electrophotographic image forming process, and the separated toner is employed again in the image forming process (see U.S. patent Ser. No. 188,838, No. 188,883, No. 266,496, No. 266,452, No. 355,687 and No. 363,007, for example).

The present invention has been made with a view of further developing the above-proposed technique.

SUMMARY OF THE INVENTION

An object of the present invention is to provide separating apparatus and an electrophotographic image forming apparatus which can continuously separate foreign matters from magnetic toner.

Another object of the present invention is to provide a separating apparatus and an electrophotographic image forming apparatus which enables magnetic toner to be reused in the formation of an image.

Still another object of the present invention is to provide a separating apparatus and an electrophotographic image forming apparatus which can efficiently remove foreign matter from magnetic toner and can offer an image of high quality even when the magnetic toner once used in the formation of an image is reused in the formation of another image.

Still another object of the present invention is to provide a separating apparatus and an electrophotographic image forming apparatus which can prevent a mesh filter from being jammed with aggregated toner lumps and/or foreign matter.

Still another object of the present invention is to provide a separating apparatus and an electrophotographic image forming apparatus in which upper magnetic poles are rotated to temporarily move away from lower magnetic poles to eliminate a concentrated magnetic field, allowing foreign matter adhered to a mesh filter to be released from the concentrated magnetic field, where the released foreign matter is attracted to the lower magnetic poles and conveyed to a collecting portion, with the result that the foreign matter is prevented from continuing to reside in the concentrated magnetic field and a good separating ability is reliably maintained at all times.

DETAILED DESCRIPTION OF THE PREFERRED EMBODIMENTS

Figure 1:
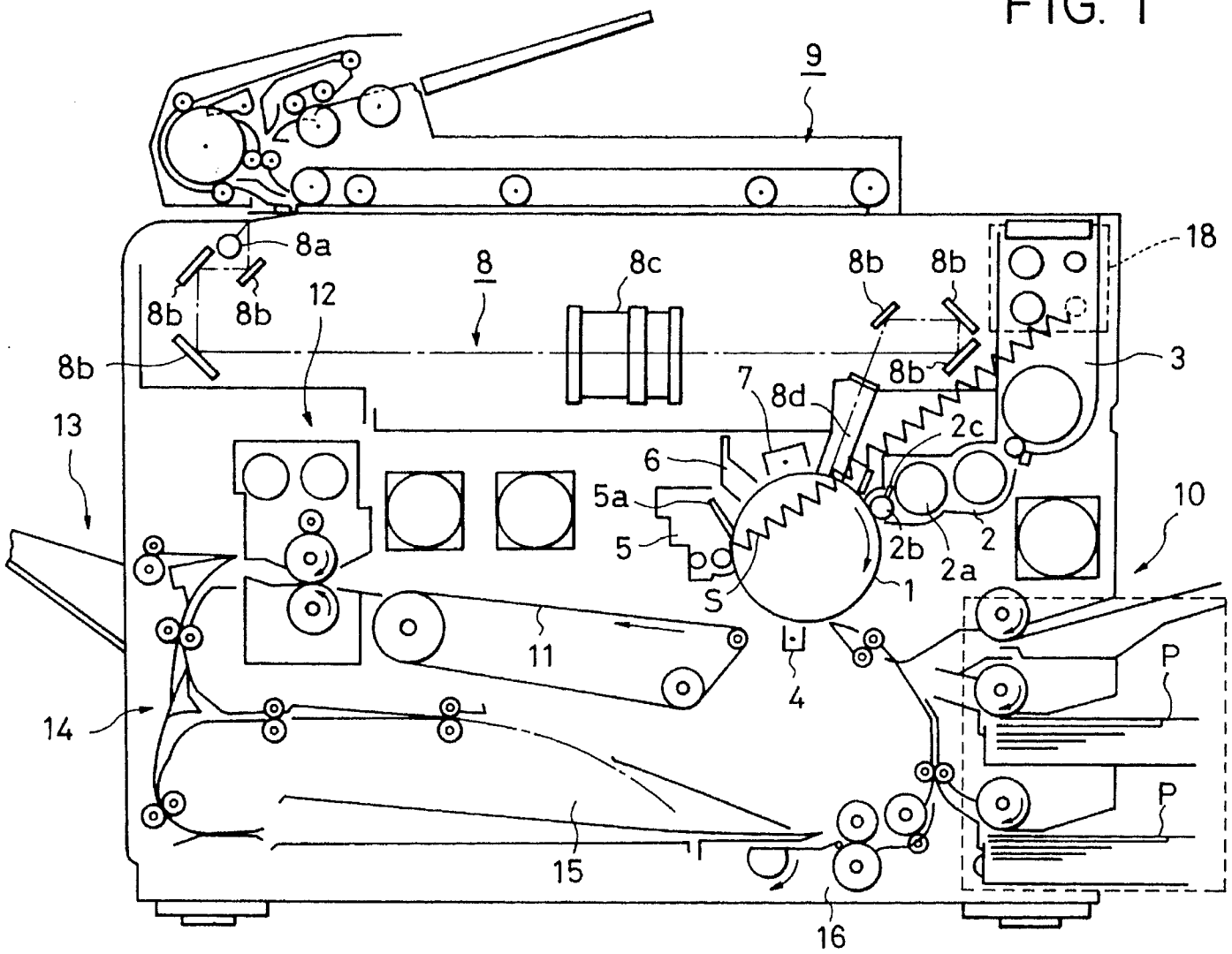
FIG. 1 a side elevational view of an electrophotographic copying machine to which one embodiment of the present invention is applied.

Initially, an embodiment of an image forming apparatus having a separating apparatus of the present invention will be explained with reference to the accompanying drawings. FIG. 1 is a schematic elevational sectional view of an electrophotographic copying machine as the image forming apparatus.

In FIG. 1, the image forming apparatus, i.e., the copying machine, comprises an image bearing member (for example, a drum-like or belt-like electrophotographic photosensitive member) 1, a developing device 2 adapted to visualize a latent image formed on the image bearing member 1 (i.e., develop the latent image) with developer and having a hopper portion 3 for supplying developer (one-component magnetic toner in the illustrated embodiment), a transfer means 4 for transferring a toner image visualized on the image bearing member 1 onto a sheet (recording medium) P, a cleaning device 5 for removing residual toner and other foreign matter remaining on the image bearing member 1, an electricity removal means 6 for removing residual charge remaining on the image bearing member 1, a first charger 7 for uniformly charging the image bearing member 1, an optical reading system 8 for reading image information on an original, and an exposure portion 8*a* for exposing the image information on the image bearing member 1 to form the latent image. An original handling device 9 for directing the original to an image reading portion and a sheet supply portion 10 for supplying a sheet P to the image reading portion are associated with the image forming apparatus.

The image forming apparatus further comprises convey means 11 for conveying a sheet P, a fixing device 12 for fixing an image (toner image) transferred to a sheet P at the image forming portion to the sheet P, a sheet discharge portion 13 for discharging the sheet P on which the image has been formed, a re-supply sheet handling portion 14 for directing a sheet P to be re-supplied in a both-face recording mode or a multi-recording mode to the image forming portion again, an intermediate tray 15 for temporarily storing sheets to be re-supplied, and a sheet re-supplying portion 16 for supplying sheets stored on the intermediate tray 15 to the image forming portion again.

Next, an operation of the image forming apparatus will be explained. When a copy start button 76 (FIG. 11) is depressed, an original in the original handling device 9 is directed to the image reading portion, to radiate an image surface with a light source 8*a*, and to form the reflected light via mirrors 8*b* and an image-forming lens 8*c* as a light image. In the image reading portion, the image information on the thus is read by the optical reading system 8.

On the other hand, the image bearing member 1 from which electrical charge was previously removed by charge removal means 6 is charged to a predetermined potential by the first charger 7, at the exposure portion 8*d*, the image information is written on the image bearing member as a latent image. The latent image formed on the image bearing member 1 is visualized with magnetic toner by the developing device 2 as a toner image. When the amount of magnetic toner in the developing device 2 is decreased, new magnetic toner is replenished to the developing device from the hopper portion 3. That is, magnetic toner supplied from the hopper portion 3 is fed by a toner feed roller 2*a* to be adhered to a surface of a developing roller 2*b*. Then, a thickness of the toner layer is regulated by a developing blade 2*c*. A developing bias is applied between the developing roller 2*b* and the photosensitive drum 1 to develop the latent image formed on the drum. When a sheet P is sent to a transfer station of the image forming portion from the sheet supply portion 10, the toner image formed on the image bearing member 1 is transferred onto the sheet P by the transfer means 4. After the transferring operation, the sheet P is sent to the fixing device 12, where the toner image is fixed to the sheet P.

After the fixing operation, in a one-face copy mode, the sheet P is discharged to the discharge portion 13. On the other hand, in a both-face copy mode or a multi-copy mode, the sheet is not discharged to the discharge portion, but is sent to the re-supply sheet handling portion 14 by which the sheet is then stored on the intermediate tray 15. When a predetermined number of sheets are stacked on the intermediate tray, the sheets are separated one by one by means of the re-supplying portion 16, and each separated sheet is re-supplied to the transfer station of the image forming portion. When a next original is sent to the image reading portion by the original handling device 9, the above-mentioned image forming operations are repeated, thereby forming a fixed toner image on the other surface of the sheet P. Then, the sheet P is discharged to the discharge portion 13.

After a transferring operation, toner (which was not transferred from the image bearing member 1 to the sheet P) and paper powder, dust and the like (referred to as "foreign matter" hereinafter) remaining on the image bearing member are removed by the cleaning device 5 (in the illustrated embodiment, the toner and the foreign matter remaining on the image bearing member 1 are removed by an elastic cleaning blade 5*a*). The removed toner and foreign matter are sent, by a screw S, to a separating apparatus 18 which will be described later.

The separating apparatus 18 will be explained below with reference to FIGS. 2 to 6.

Figure 2:
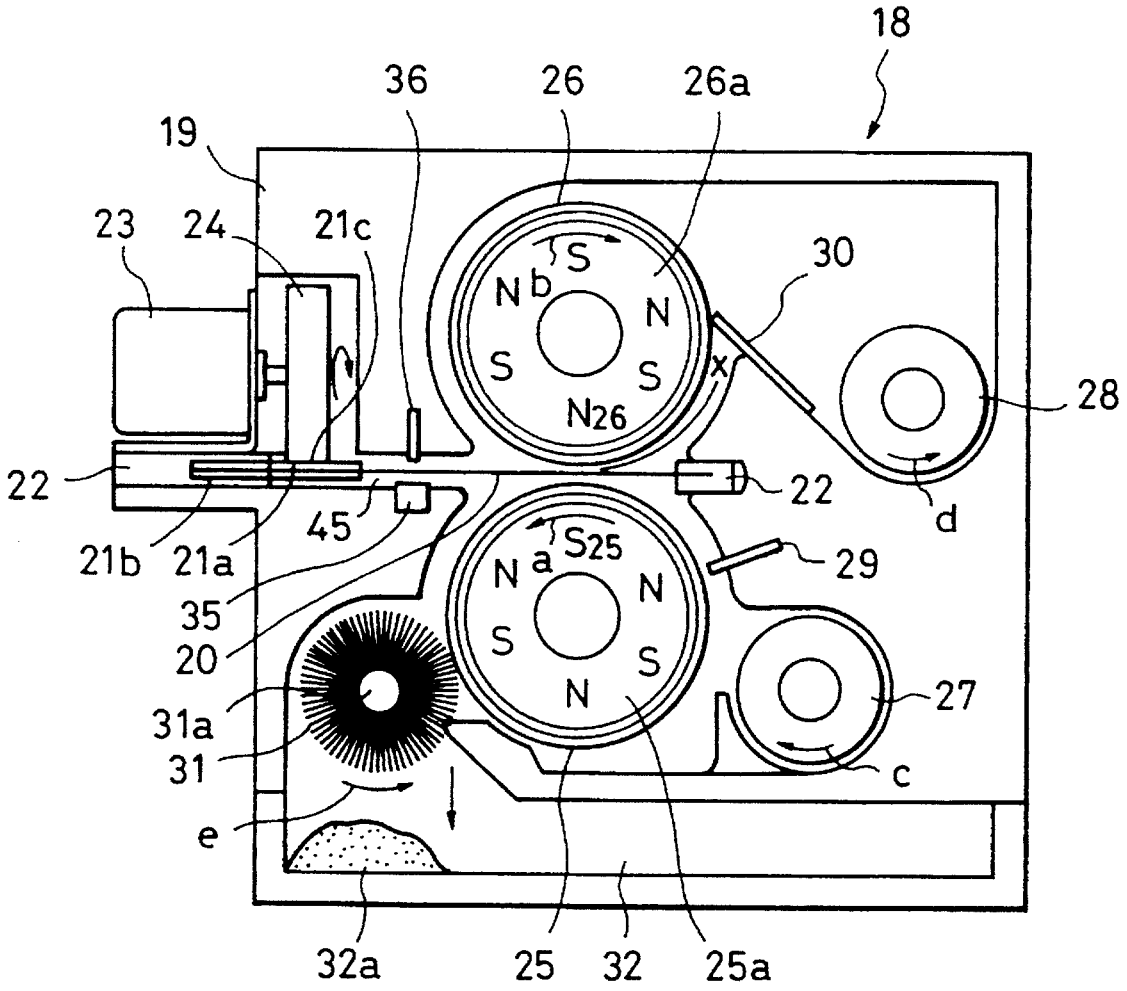
FIG. 2 a side elevational view of a separating apparatus to which one embodiment of the present invention is applied.

FIG. 2 illustrates an embodiment of the present invention and is a side cross section of the separating apparatus for separating the toner, which is collected by the cleaning device of the image forming apparatus, from foreign matter and returning only the separated toner to the developing device.

The separating apparatus 18 has a frame 19 within which a mesh filter 20 made of non-magnetic material (for example, non-magnetic stainless steel wires, non-magnetic brass wires or the like) is disposed. The mesh filter 20 is pinched between flexible sheets 21*a*, 21*b* formed of stainless steel sheets and is supported by a support member 22 at its periphery. A motor 23 is mounted to the support member 22 and an eccentric cam 24 attached to a drive shaft of the motor 23 is contacted with one of the flexible sheets 21*a*, 21*b* so that vibration is applied to the mesh filter 20 through the flexible sheets 21*a*, 21*b* when the motor 23 is driven. Since each of the flexible sheets 21*a*, 21*b* has a thickness of about 0.05 to 0.2 mm, vibration can easily be transmitted to the mesh filter through the flexible sheets and vibration noise is very small, and, thus, noise does not leak to the exterior.

The frame 19 has inner spaces defined above and below the mesh filter 20. The lower space houses a sleeve 25 incorporating a magnet roller 25*a* as a magnetic force generating means which has N poles and S poles alternately arranged in the circumferential direction. The upper space houses a sleeve 26 incorporating a magnet roller 26*a* as a magnetic force generating means which is structured similarly to the above magnet roller. The sleeves 25, 26 are rotated by an appropriate drive source (not shown) in directions shown by arrows a, b in FIG. 2.

The sleeves 25, 26 are synchronously rotated such that, as shown, opposite poles of the respective magnet rollers 25*a*, 26*a* face each other at a position where the sleeves come close to each other with the interposition of the mesh filter 20 therebetween. Also, the magnet rollers 25*a*, 26*a* are selected such that the upper magnetic pole (for example, $N_{26}$) has a magnetic force greater than the lower magnetic pole (for example, $S_{25}$).

A pipe is extended from the cleaning device 5 into the lower space of the frame 19 (see FIG. 3), and a convey screw 27 provided in the pipe has its end located in the lower space, as shown in FIG. 2, for introducing used toner including foreign matter to the lower space. Another pipe is extended from the developing device including the hopper portion into the upper space of the frame 19, and a convey screw 28 provided in the pipe has its end located in the upper space for conveying toner, from which foreign matter has been separated, to the developing device 2.

Although an electromagnet, a permanent magnet or the like can be employed as the magnetic force generating means disposed in each of the sleeves 25, 26 a permanent magnet is preferably employed because of simple structure and cost efficiency. Although synthetic resins, stainless steel, aluminum or the like can be used as the material of sleeves 25, 26, aluminum is superior from the standpoints of cost and durability. Incidentally, the separating apparatus further includes a doctor blade 29 for regulating a thickness of a toner layer adhered to a surface of the lower sleeve 25, and a scrape blade 30 for scraping off toner adhered to a surface of the upper sleeve 26.

A basic operation of the separating apparatus 18 will be explained. Initially, toner including foreign matter conveyed by the screw 27 into the lower space of the frame 29 is adhered to the lower sleeve 25 with a thickness regulated by the doctor blade 29, and then reaches a separating zone X in which the lower sleeve 25, the mesh filter 20 and the upper sleeve 26 are positioned in close relation to create a concentrated magnetic field.

At this time, since the upper sleeve 26 generates a magnetic force greater than that generated by the lower sleeve 25 as mentioned above, the toner is attracted by and moved toward the upper sleeve 26. On other hand, the foreign matter having a large particle size cannot pass through the mesh filter 20, remains adhered to the undersurface of the mesh filter 20, and then is dropped toward the lower sleeve 25 with the vibration of the mesh filter 20.

The dropped foreign matter is conveyed together with the lower sleeve 25 as it is rotated, and is scraped by the brush 31 made of non-magnetic material to be stored in a collecting portion 32. At this time, residual toner which has not been separated at the separating zone X and is attracted by and adhered to the lower sleeve 25 by the magnetic force after dropping from the mesh filter 20, is not scraped by the brush 31 but is further conveyed together with the lower sleeve 25 for preparation of the next separation. Thus, almost no toner is collected in the collecting portion 32, only foreign matter is collected in the collecting portion 32.

On the other hand, toner having passed through the mesh filter 20 and free from foreign matter is adhered to the upper sleeve 26 and is conveyed together therewith. Then, the toner adhered to the upper sleeve 26 is scraped off by the scrape blade 30 and is sent by the convey screw 28 to the developing device 2 to be reused.

The separating apparatus 18 will be explained below in detail.

As shown in FIG. 2, the separating apparatus 18 has a frame 19 within which a mesh filter 20 made of non-magnetic material (for example, non-magnetic stainless steel wires, non-magnetic brass wires, nylon fibers or the like) is arranged along a direction substantially perpendicular to the gravity acting direction (i.e., at an inclination angle of 0° with respect to a horizontal plane). Sleeves 25, 26 (for example, made of aluminum) incorporating respective magnetic rollers 25*a*, 26*a* are disposed above and below the mesh filter 20. Incidentally, as shown, each magnet roller 25*a*, 26*a* has N poles and S poles alternately arranged. In a condition that magnetic poles $S_{25}$ and $N_{26}$ are opposed to each other as shown in FIG. 2, the sleeves 25, 26 are rotated in directions shown by arrows a, b in FIG. 2. That is to say, the sleeves 25, 26 are rotated in opposite directions. By the rotation of sleeve 25, residual toner and foreign matter adhered to a surface of the sleeve 25 is shifted in the same direction as the rotational direction of the sleeve 25. On the other hand, by the rotation of sleeve 26, magnetic toner adhered to a surface of the sleeve 26 is shifted in the same direction as the rotational direction of the sleeve 26.

Incidentally, a relation between magnetic forces of the magnetic poles $S_{25}$, $N_{26}$ at a separating zone X where the sleeves 25, 26 are opposed to each other with the interposition of the mesh filter 20 by which the foreign matter is separated from the magnetic toner is $N_{26}>S_{25}$.

Further, convey screws 27, 28 for conveying the toner are associated with the separating apparatus 18. Convey screw 27 serves to convey magnetic toner and the foreign matter collected in the cleaning device 5 to the separating apparatus 18, and convey screw 28 serves to convey magnetic toner (from which the foreign matter is removed) to the hopper portion 3 of the developing device 2. A doctor blade 29 serves to regulate a thickness of a layer of the residual toner and foreign matter adhered to the sleeve 25, and a scraper blade 30 serves to scrape off magnetic toner adhered to sleeve 26 and to guide the scraped toner to the convey screw 28.

Next, a separating operation of the separating apparatus 18 for separating the foreign matter from the magnetic toner will be explained. Initially, the mixture of magnetic toner and foreign matter removed from the image bearing member 1 by the cleaning device 5 is supplied to the proximity of the sleeve 25 in the separating apparatus 18 by means of the convey screw 27. Then, the mixture is adhered to the surface of the sleeve 25 to be conveyed upwardly by the rotation of sleeve 25. That is to say, the mixture is sen to the separating zone X. Although foreign matter such as paper powder is non-magnetic, since it is mixed with the magnetic toner when the residual matter is removed from the image bearing member 1, the foreign matter is adhered to the surface of the sleeve 25 together with the magnetic toner. A thickness of a layer of the mixture of the magnetic toner and foreign matter adhered to the sleeve 25 is regulated by the doctor blade 29 to a predetermined thickness, and the mixture is sent to the separating zone X where the sleeves 25, 26 are opposed to each other.

As mentioned above, the relation between magnetic forces of the magnetic poles $S_{25}$, $N_{26}$ at a separating zone X is $N_{26}>S_{25}$. Thus, the mixture sent to the separating zone X by the sleeve 25 is flying from the surface of the sleeve 25 toward the surface of the sleeve 26 under the action of magnetic fields formed by the magnetic rollers 25*a*, 26*a*. In this case, since there is a mesh filter 20 between the sleeves 25, 26, only magnetic toner having a small particle diameter can pass through the mesh of the mesh filter 20, and foreign mater such as paper powders each having a particle diameter substantially greater than that of the magnetic toner cannot pass through the mesh filter 20.

Since the mesh of the mesh filter 20 (preferably, 150 μm (#100) to 37.5 μm (#400)) has an opening greater than the particle diameter of the magnetic toner (average particle diameter of 5 to 20 μm) by several times, the magnetic toner can smoothly pass through the mesh of the filter.

On the other hand, since the magnetic toner adhered to the foreign matter is flying toward the surface of the sleeve 26, with the result that a force for flying the foreign matter in opposition to the gravity force is greatly reduced. Therefore, the non-magnetic foreign matter which cannot pass through the mesh of the filter 20 drops onto the surface of the sleeve 25 by its own weight.

Further, in the illustrated embodiment, even if the foreign matter is caught by the mesh of the filter 20, since vibration is applied to the filter 20 by a vibration applying means to be explained later, the foreign matter caught by the filter 20 can be dropped due to the vibration. Thus, the foreign matter will be removed from the magnetic toner. The magnetic toner which has been separated from the foreign matter is conveyed to the hopper portion 3, in which non-used toner is stored, to be mixed with the toner for reuse.

Figure 4:
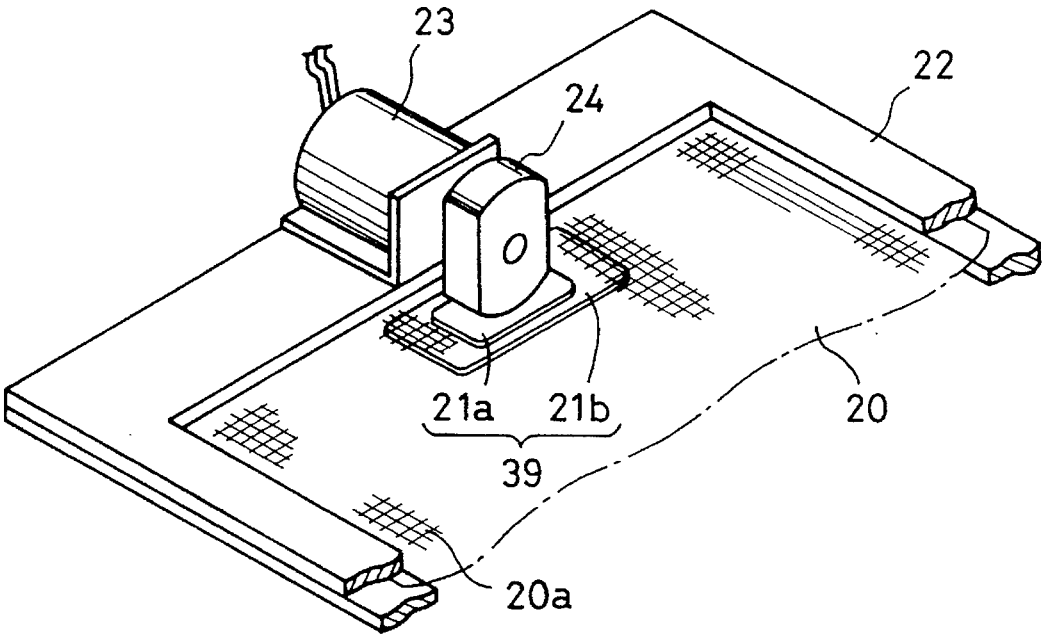
FIG. 4 is a perspective view showing a mechanism used with the separating apparatus shown in FIG. 2 for applying vibration to a mesh filter.
Figure 5:
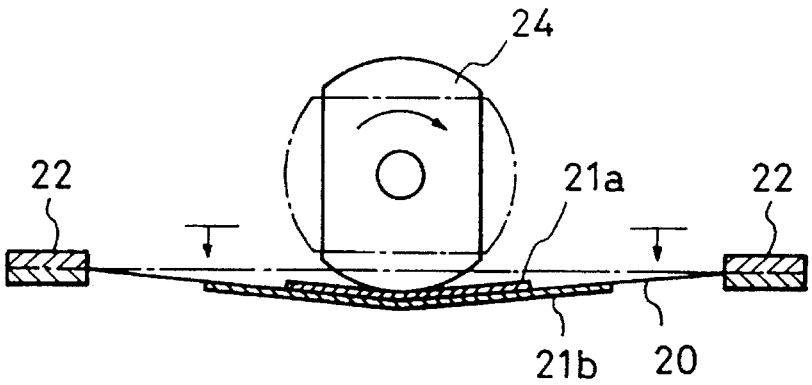
FIG. 5 is a side elevational view of the mechanism shown in FIG. 4.

The separating apparatus 18 will be further described. In FIGS. 2, 4 and 5, the mesh filter 20 is pinched between flexible sheets 21*a*, 21*b* at its one end and is held together with the flexible sheets by the frame 19 of the separating apparatus 18 via a support member 22. A drive motor 23 to which an eccentric cam (vibration applying means) 24 for applying the vibration to the mesh filter 20 is connected is attached to the support member 22. The eccentric cam 24 connected to the drive motor 23 is contacted with one of the flexible sheets 21*a*, 21*b* so that the vibration is applied to the flexible sheets 21*a*, 21*b* by rotation of the cam 24 when the motor 23 is driven, with the result that the vibration is transmitted to the mesh filter 20 through the flexible sheets 21*a*, 21*b*.

Upper and lower sleeves 26, 25 incorporating magnet rollers (magnetic force generating means) 26*a*, 25*a* therein are arranged above and below the mesh filter 20, respectively. The driving force from a drive source M of the image forming apparatus is transmitted to drive gears (not shown) via a drive belt (not shown) extending between a drive pulley (not shown) of the image forming apparatus and a drive pulley (not shown) of the separating apparatus. As a result, the sleeves 25, 26 are rotated in directions shown by arrows a, b in FIG. 2. Incidentally, a relation between magnetic forces of magnetic poles $S_{25}$, $N_{26}$ at the separating zone X where the upper sleeve 26 is opposed to the lower sleeve 25 with the interposition of the mesh filter 20 by which the foreign matter are separated from the magnetic toner is set to $N_{26}>S_{25}$.

A magnet 35 opposed to a magnetic plate 36 with the interposition of the mesh filter 20 is arranged in a communication passage 45 between the separating zone X and a vibration applying portion 21*a* (i.e., contact portion between the flexible sheets 21*a*, 21*b* and the eccentric cam 24 connected to the drive motor 23), thereby creating a concentrated magnetic field. With this arrangement, floating toner particles are caught by the concentrated magnetic field, thereby preventing the toner from entering into the vibration applying portion 21*a*.

The driving force from the drive source M of the image forming apparatus is transmitted to convey screws 27, 28 (for conveying the toner) via screw drive gears (not shown) meshed with drive gears (not shown) for the sleeves 25, 26, respectively. Thus, the convey screws 27, 28 are rotated in directions shown by arrows c, d in FIG. 2, respectively. The convey screw 27 serves to convey toner (including foreign matters such as paper powder, dust and the like) collected by the cleaning device 5 to the separating apparatus 18, and the convey screw 28 serves to convey toner from which the foreign matter has been removed to the developing device 2 including the hopper portion 3. Further, a brush 31 serves to scrape off foreign matter adhered to the surface of the lower sleeve 25 together with the residual toner into a collecting portion 32. The driving force from the drive source M of the image forming apparatus is transmitted to the brush 31 through a drive gear (not shown) connected to the drive gear (not shown) for the lower sleeve 25 via an idler gear (not shown) so that the brush 31 is rotated in a direction shown by arrow e in FIG. 2 (same as the rotational direction of the lower sleeve 25) at a low speed.

Next, a separating operation of the separating apparatus 18 for treating the collected toner (including foreign matters such as paper powder, dust and the like) will be explained.

As mentioned above, toner collected from the photosensitive drum 1 by the cleaning device 5 is supplied to the lower sleeve 25 in the separating apparatus 18 by means of the convey screw 27. Incidentally, the collected toner includes foreign matters such as paper powder, dust and the like. The collected toner is adhered to the lower sleeve 25 by the magnet force, so that, as the sleeve 25 is rotated, the toner is conveyed upwardly. Meanwhile, a thickness of the toner layer adhered to the lower sleeve 25 is regulated by the doctor blade 29 to a predetermined thickness. In this way, the collected toner is sent to the separating zone X where the sleeves 25, 26 are opposed to each other with the interposition of the mesh filter 20.

As mentioned above, the relation between magnetic forces of the magnetic pole $N_{26}$ of the upper sleeve 26 and the magnetic pole $S_{25}$ of the lower sleeve 25 at a separating zone X is set to $N_{26}>S_{25}$. Thus, the collected toner (magnetic toner) sent to the separating zone X by the lower sleeve 25 is effectively attracted by the concentrated magnetic force extending from the magnetic pole $S_{25}$ of the lower sleeve 25 to the magnetic pole $N_{26}$ of the upper sleeve 26, with the result that only the magnetic toner is forcibly pulled upwardly toward the upper sleeve 26 in opposition to the gravity force, causing the toner to adhere to the upper sleeve 26. In this way, the magnetic toner is separated from foreign matter.

Figure 6:
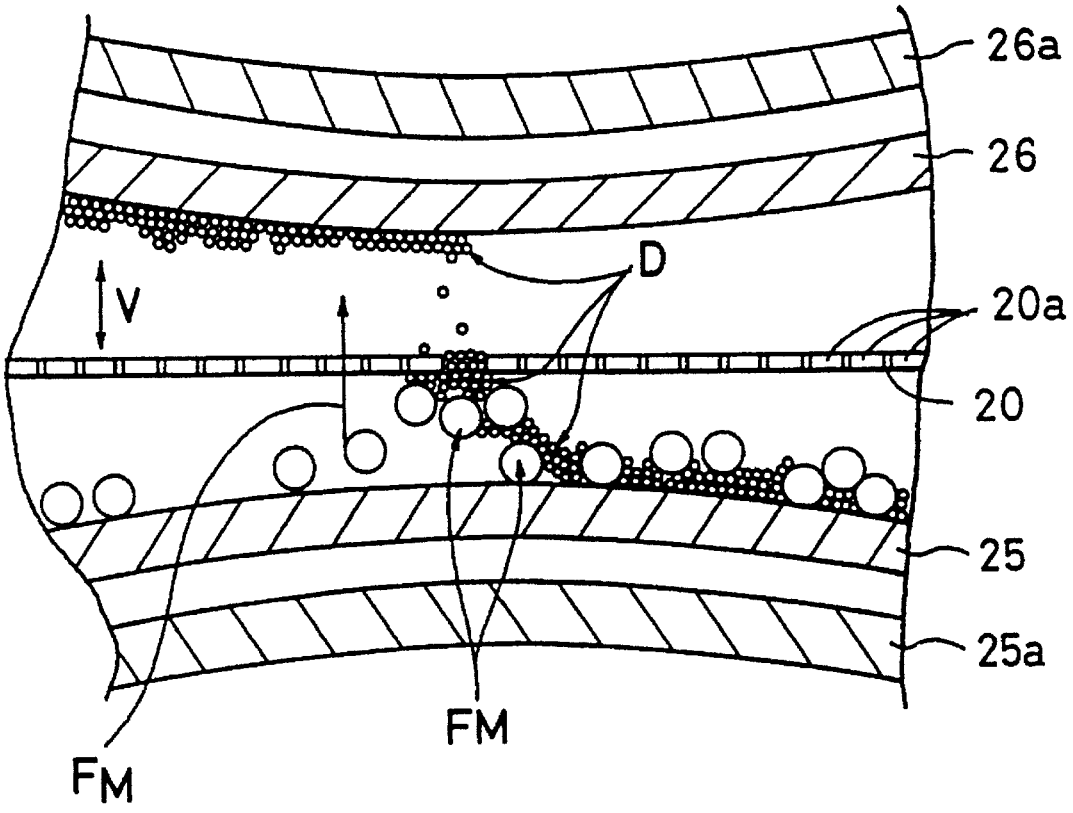
FIG. 6 is an explanatory view showing a condition where magnetic toner is separated from foreign matters in the separating apparatus shown in FIG. 2.

As shown in FIG. 6, the mesh filter 20 has openings 20*a* each having a dimension greater than a diameter of the toner particles by several times (preferably, each opening has a size of 150 μm (#100) to 37.5 μm (#400)). Thus, in an initial clean condition, the toner can smoothly pass through the mesh filter. However, as the separating time goes on, since aggregated toner lumps are accumulated in the openings of the mesh filter 20 to such an extent as not to pass through the filter (particularly, under a high humidity condition), thereby giving rise to a so-called filter jam. However, in the illustrated embodiment, the filter 20 is vibrated (preferably, with a frequency of 50 Hz or more and an amplitude of about 0.2 to 4.0 mm) in a substantially vertical direction through the thin flexible sheets 21 (21*a*, 21*b*) (preferably, having a thickness of about 0.05 to 0.2 mm) by the eccentric cam 24 connected to the drive motor 23. Thus, toner lumps caught by the filter 20 are decomposed by the vibration of the filter to eliminate filter jam, so that the toner can easily be separated from the filter 20 (refer to FIGS. 4 and 5).

Further, as mentioned above, since the flexible sheets 21*a*, 21*b* pinching one end of the mesh filter 20 near the vibration applying position are thin, they can be well restored from the flexure caused by the vibration. Thus, the flexible sheets 21*a*, 21*b* are finely vibrated to transmit the vibration to the filter 20, thereby effectively vibrating the mesh filter 20 without deforming the filter. Further, as mentioned above, since the flexible sheets 21*a*, 21*b* are thin layers having a thickness of about 0.05 to 0.2 mm, even when the flexible sheets are vibrated, vibration noise is very small, and, thus, the noise does not leak to the exterior.

Further, at the separating zone X, although the toner is forcibly separated and conveyed by the magnetic force in opposition to the gravity force, toner particles deviated from the magnetic field during the conveyance of the toner are floating in the frame of the separating apparatus. However, since the interior of the frame 19 within which the sleeves 25, 26 are disposed is completely enclosed, the floating toner can be prevented from leaking outside. Further, within the frame 19, the separating zone X is in spatial communication with the vibration applying portion 21*c* through the communication passage 45. However, since floating toner is caught by the concentrated magnetic field generated by the magnet 35 and the magnet plate 36 opposed to each other with the interposition of the mesh filter 20 within the communication passage 45, separating toner is prevented from reaching the vibration applying portion 21*c*. Further, as the separating time goes on, although an amount of the toner adhered to the magnet 35 and the magnetic plate 36 is gradually increased, since the toner consists of toner particles each having a diameter of about 10 μm, the connecting condition between the toner particles has versatility. Thus, even if the toner particles adhered to the magnet 35 or the magnetic plate 36 are contacted with the mesh plate 20, the vibration of the filter 20 is not damped, and, thus, the vibration generated by the drive motor 23 as the vibration applying means can effectively be transmitted to the mesh filter 20.

Further, in the illustrated embodiment, since it is selected so that the toner conveying force due to the magnetic force is sufficiently greater than the weight of the toner particle itself, the toner can easily be conveyed to and be adhered to the upper sleeve 26.

Further, in the illustrated embodiment, it is designed so that toner including foreign matter is conveyed upwardly in opposition to the gravity force through the mesh filter 20 to separate the foreign matter from the magnetic toner. Thus, separated foreign matter 32*a* such as paper powder, dust and the like are adhered to the under-surface of the mesh filter 20. However, since the mesh filter 20 is vibrated, any foreign matter is dropped from the filter by its own weight. Therefore, the foreign matter can effectively be separated from the toner, and filter jam can be prevented continuously (see FIG. 6).

Further, the toner (from which the foreign matter is separated) adhered to the upper sleeve 26 is conveyed downstream as the upper sleeve 26 is rotated, and is scraped off from the surface of the upper sleeve 26 by the scraper blade 30, and the toner scraped off is conveyed out of the separating apparatus 18 by the convey screw 28. Then, the toner is conveyed by a convey means (not shown) to the developing device 2 including the hopper portion 3 to be reused in the development.

The foreign matter separated from the magnetic toner at the separating zone X and dropped from the mesh filter is dropped onto the lower sleeve 25 and then is conveyed together with the residual toner (not flying toward the upper sleeve) as the lower sleeve is rotated. Then, the foreign matter is scraped off of the lower sleeve 25 by the non-magnetic brush 31 arranged at a downstream side of the separating zone X in the toner conveying direction. Since the non-magnetic brush 31 is urged against the sleeve 25 with weak pressure, the foreign matter can be scraped off of the sleeve. However, since the residual toner not separated at the separating zone X is adhered to the sleeve 25 by a magnetic force, the residual toner is not scraped off by brush 31 but is further conveyed downstream for preparation of the next separation operation. Thus, almost no toner is collected in the collecting portion 32; only foreign matter 32*a* is collected in the collecting portion 32.

As explained above, since the aggregated toner lumps are decomposed and the foreign matter adhered to the mesh filter 20 is dropped in the gravity acting direction with the vibration of the mesh filter, filter jam can be prevented at all times and the toner efficiently can be separated from the foreign matter continuously.

In the illustrated embodiment, the separating apparatus 18 also has a function of eliminating the concentrated magnetic field to prevent mesh jam. A means for eliminating the concentrated magnetic field will be explained below.

Figure 3:
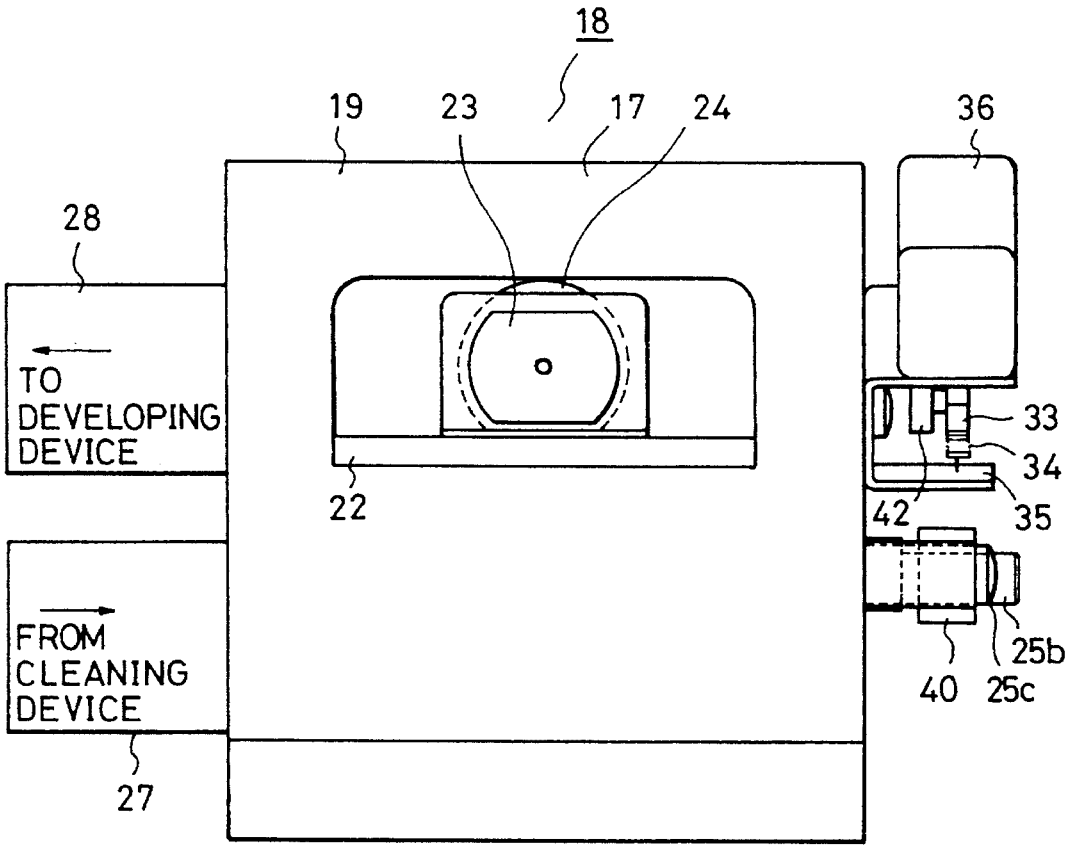
FIG. 3 is a plan view showing a mechanism used with the separating apparatus shown in FIG. 2 for eliminating a concentrated magnetic field.
Figure 7:
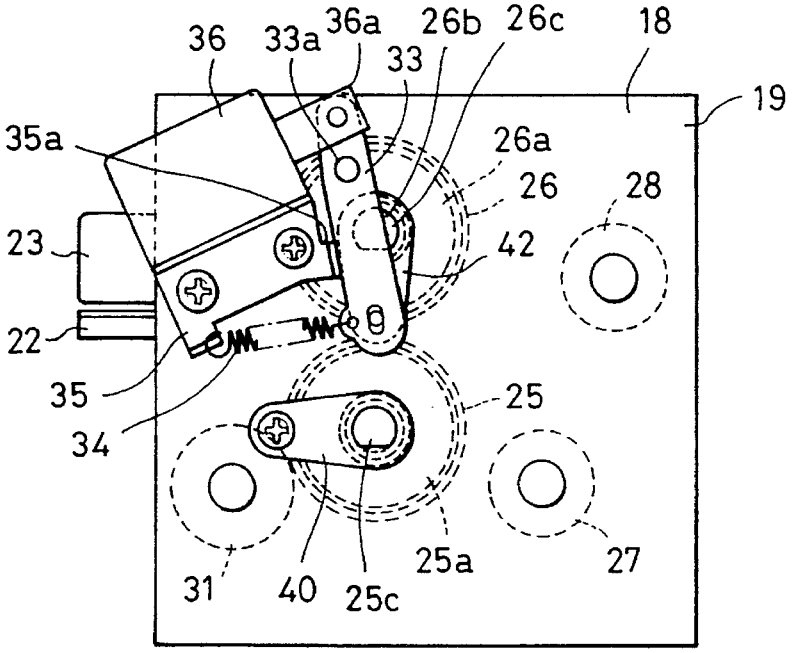
FIG. 7 is a side elevational view showing the mechanism used with the separating apparatus shown in FIG. 2 for eliminating the concentrated magnetic field.
Figure 8:
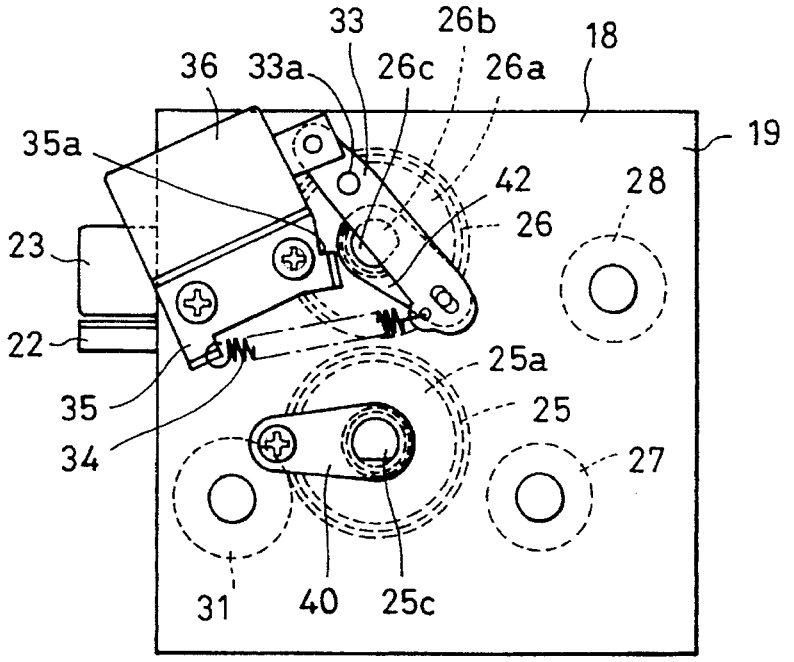
FIG. 8 is a side elevational view showing the mechanism used with the separating apparatus shown in FIG. 2 for eliminating the concentrated magnetic field.

As shown in FIGS. 3, 7 and 8, a magnetic pole holding member 40 is attached to an end 25*c* of a shaft 25*b* supporting the magnet roller 25a in the sleeve 25, and is fixed to the frame 19 by means of a screw or the like for holding the magnetic roller and hence its magnetic poles in a fixed position.

A magnetic pole holding member 42 is attached to an outwardly projected end 26*c* of a shaft 26*b* supporting the magnet roller 26*a* in the sleeve 26. A lever 33 is pivotally attached to a pin 33*a* fixed to an appropriate position on the frame 19, and has one end coupled to an end of the magnetic pole holding member 42. The other end of the lever 33 is connected to a plunger 36*a* of a solenoid unit 36 attached to a support plate 35 which is fixed to the frame 19.

A coiled spring 34 is extended between the support plate 35 and one end of the lever 33 for biasing the lever 33 and hence the magnetic pole holding member 42 in the clockwise direction in FIGS. 7 and 8. The lever 33 is brought into contact with a stop 35a formed on the support plate 35 to hold the sleeve 26 a predetermined position. In this position, the magnet roller 26*a* in the upper sleeve 26 and the magnet roller 25*a* in the lower sleeve 25 are arranged to create the concentrated magnetic field, as shown in FIG. 2, for the toner conveying and separating process mentioned above.

When the solenoid unit 36 is energized manually by an operator who judges the timing at which the mesh filter 20 has been jammed with foreign matter clinging thereto and the separating ability has decreased, or automatically by an electric signal issued from a control portion 100 (see FIG. 11) in which the above timing is previously set, the lever 33 and the magnetic pole holding member 42 are rotated in the counterclockwise direction to the state shown in FIG. 8. In the former manual operation by the operator, the solenoid unit 36 is energized when the operator turns on a drive button (not shown).

Accordingly, the magnetic poles in the lower sleeve 25 are moved away from the magnetic poles in the upper sleeve 26 in the frame 19, thereby eliminating the concentrated magnetic field. As a result, foreign matter clinging to the mesh filter 20 and toner adhered to the foreign matter are dropped toward the sleeve 25 to be collected in the collecting portion 32.

When the solenoid unit 36 is de-energized, the lever 33 and the magnetic pole holding member 42 are returned to the condition shown in FIG. 7 where the sleeves 25, 26 create the concentrated magnetic field in the frame again for restarting the toner conveying and separating process. At this time, since the mesh jam is eliminated, the separating operation is continued smoothly.

The timing of retracting the poles of the magnet roller 26*a* in the upper sleeve 26 and the retraction angle of the upper sleeve 26 will be explained below. The magnetic pole retracting timing will first be explained. If the retracting timing is too late, foreign matter would be firmly held to the mesh filter 20 and would not separate from it even with the retraction of the magnetic poles. Therefore, the magnetic poles are preferably retracted once per 1–5000 rotations of the sleeves 25, 26. Depending on the strength and the half width of a magnetic force in the separating zone where the sleeves are opposed to each other; the retraction angle (i.e., the angle by which the lever 33 is to be rotated) is preferably the range of 30 to 90 degrees, more preferably in the range of 50 to 90 degrees.

Thus, according to the illustrated embodiment, the concentrated magnetic field can be eliminated as needed and, hence, the toner and the foreign matter accumulated on the undersurface of the mesh filter can forcibly be dropped and conveyed downstream to be collected in the collecting portion. Therefore, in the event the mesh filter 20 is jammed with aggregated toner lumps and the foreign matter, it is possible to prevent the used toner successively supplied to the lower sleeve from further accumulating in the proximity of the concentrated magnetic field.

While, in the separating apparatus explained above as one embodiment, a pair of sleeves are vertically arranged and the used toner is supplied to the lower sleeve so that the toner is attracted to move upwardly for separation from the foreign matter, the present invention is not limited to the illustrated arrangement. By way of example, the separating apparatus may be arranged such that the used toner is supplied to the upper sleeve for attracting the toner to move downwardly for separation from the foreign matter, and the lower sleeve is angularly moved to eliminate the concentrated magnetic field, causing the foreign matter and the toner adhered thereto to be attracted and conveyed with the upper sleeve.

Although the foregoing description has been made in connection with the embodiment in which the present invention is applied to the image forming apparatus using magnetic toner, the present invention is not limited to the illustrated embodiment. It is a matter of course that the present invention is applicable to general mixtures of magnetic powders and non-magnetic foreign matter for separating the foreign matter from the magnetic.

Figure 9:
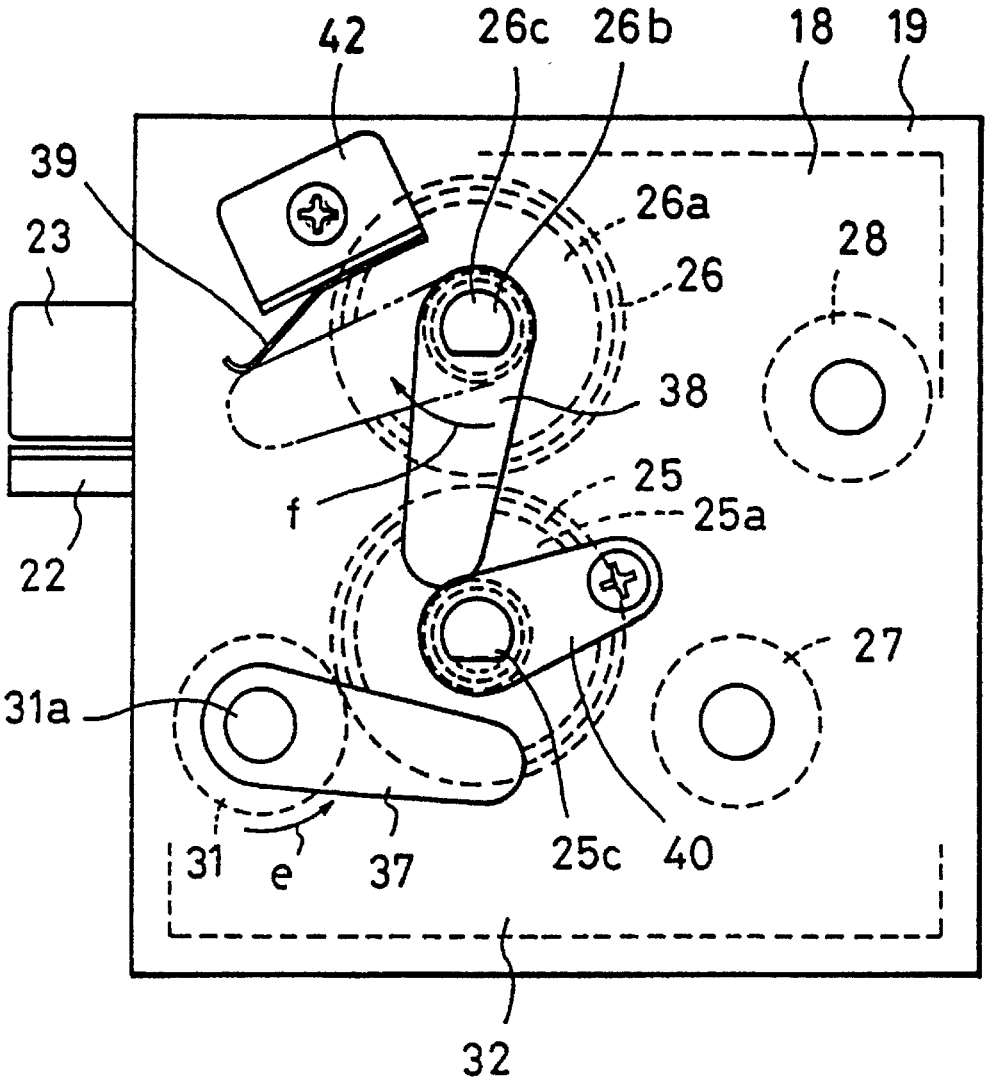
FIG. 9 is a side elevational view showing another embodiment of the mechanism for eliminating the concentrated magnetic field.

FIG. 9 shows a side elevation of a separating apparatus according to another embodiment of the present invention. A separating apparatus 18 similar to that used in the foregoing embodiment is housed in the frame 19. As seen, an end 26*c* of a shaft supporting the magnet roller 26*a* in the upper sleeve 26 and an end 25*c* of a shaft supporting the magnet roller 25*a* in the lower sleeve 25 appear in FIG. 9. An end 31*a* of a shaft supporting the brush 31 disposed in the frame 19 also appears in FIG. 9.

Further, a lever 37 is attached to the shaft end 31*a* of the brush 31 and is rotated at a low speed in a direction shown by arrow e. A magnetic pole holding member 38 is fixed to the shaft end 26*c* of the magnet roller 26*a* in the upper sleeve 26, and a leaf spring 39 is attached to a support plate 42*d* fixed to a side wall of the frame 19 for regulating the range within which the magnetic pole holding member 38 is rotatable.

A magnetic pole holding member 40 is attached to the shaft end 25*c* of the magnet roller 25 in the lower sleeve 25, and is fixed to the side wall of the frame 19 by means of a screw or the like, thereby holding the magnet roller 25*a* and hence its magnetic poles in a fixed position.

When the respective components are positioned as shown in FIG. 9, the concentrated magnetic field is created in the proximity of the mesh filter 20 within the frame 19 as with the separating apparatus of the foregoing embodiment. In this condition, the toner and the foreign matter are separated from each other.

In the operation of the separating apparatus 18 of this embodiment, the brush 31 disposed in the collecting portion 32 is rotated and the lever 37 attached to the shaft end 31*a* of the brush 31 is rotated therewith. When the lever 37 comes into contact with the magnetic pole holding member 38, the holding member 38 is also rotated in the clockwise direction (i.e., in a direction shown by the arrow f). Correspondingly, the magnet sleeve 26*a* in the upper sleeve 26 is rotated through a predetermined angle in the clockwise direction so as to disturb the concentrated magnetic field. Then, as mentioned above, foreign matter accumulated on the undersurface of the mesh filter 20 so far is dropped and conveyed by the lower sleeve 25 to be collected in the collecting portion 32.

When the lever 37 is further rotated, the lever 37 is disengaged from the magnetic pole holding member 38 and, thereafter, the holding member 38 is rotated in the counterclockwise direction by the action of the leaf spring 39. The holding member 38 is stopped when it comes to a position where the poles of the magnet rollers 25*a*, 26*a* in the sleeves 25, 26 are opposed to each other in the frame so as to create the concentrated magnetic field again. The toner separating operation is continued in a like manner as before.

In the mechanism of this embodiment, the restoring force of the leaf spring 39 is utilized to ensure the function of returning the magnetic pole holding member 38 to its original position after the lever 37 is disengaged from the holding member 38. However, the leaf spring may be dispensed with if the rotation angle of the magnet roller 26*a* in the upper sleeve 26 and the position of the upper magnetic poles with respect to the lower magnetic poles are determined by any other suitable means such that the desired relation between the magnetic poles of the upper and lower magnet rolls 25*a*, 26*a* is established after the lever 37 and the magnetic pole holding member 38 are disengaged from each other.

Still another embodiment of the present invention will be explained with reference to FIG. 10. Note that the same and like members as those in the foregoing embodiments are denoted by the same reference numerals and will not be explained here.

A brush gear 50 is fixed to the shaft end 31*a* of the brush 31 and is rotated at a low speed by a driving force transmitted from the main motor M of the image forming apparatus through a gear train (not shown). A stepped relay gear 51 comprising a small-diameter gear 51*a* and a large-diameter gear 51*b* is fixed to the shaft end 25*c* of the magnet roller 25*a*. The small-diameter gear 51*a* of the stepped relay gear 51 is held in mesh with the brush gear 50 to receive the driving force transmitted from the brush gear 50. The large-diameter gear 51*b* of the stepped relay gear 51 has only four teeth, as shown in FIG. 10. On the other hand, a magnetic pole gear 52 is fixed to the shaft end 26*c* of the magnet roller 26*a*. The magnetic pole gear 52 can be brought into mesh with the large-diameter gear 51*b* of the stepped relay gear 51 to receive the driving force transmitted from the stepped relay gear 51. When the rotation of the stepped relay gear 51 brings the large-diameter gear 51*b* into mesh with the magnetic pole gear 51 and the driving force is transmitted to the magnetic pole gear 52, the magnet roller 26*a* is rotated through a predetermined angle in the counterclockwise direction. Thus, the magnetic pole $N_{26}$ of the magnet roller 26*a* is shifted or retracted from the position where it is opposed to the magnetic pole $S_{25}$ of the magnet roller 25*a*. In this embodiment, since the large-diameter gear 51*b* has only four teeth as mentioned above, the meshing between the large-diameter gear 51*b* and the magnetic pole gear 52 is released at the time the magnet roller 26*a* is rotated about 70 degrees. When the gears 51*b*, 52 arc disengaged from each other, the magnet roller 26*a* is returned to its original position by an attraction force produced between the magnetic poles $N_{26}$ and $S_{25}$. Thus, the positional relation between the magnetic poles of the magnet rollers 25*a*, 26*a* are restored to the relation as shown in FIG. 2. With this embodiment, therefore, the magnetic pole gear 52 is rotated once in the counterclockwise direction whenever the sleeves 25, 26 repeat rotation about 65 times (i.e., per 20 sec) and, hence, the concentrated magnetic field is eliminated. When the concentrated magnetic field is released and the magnetic force for attracting the magnetic toner to pass through the mesh filter 20 is decreased, the toner clinging to the filter 20 is attracted to the sleeve 25 by the magnetic force of the magnetic pole $S_{25}$. Consequently, according to this embodiment, the mesh filter 20 is prevented from being jammed with aggregated toner lumps and foreign matter, and the toner separating ability of the separating apparatus 18 can be sustained continuously. In the illustrated embodiment, the magnet roller 26*a* is rotated about 70 degrees to eliminate the concentrated magnetic field. It has, however, been confirmed that jamming of the mesh filter 20 can be prevented insofar as the angle by which the magnet roller 26*a* is rotated is kept within a certain range, preferably the range of about 50 to 90 degrees. The timing at which the magnet roller 26*a* is rotated to eliminate the concentrated magnetic field is not limited to that explained in the foregoing embodiment, but may be selected appropriately.

Figure 11:
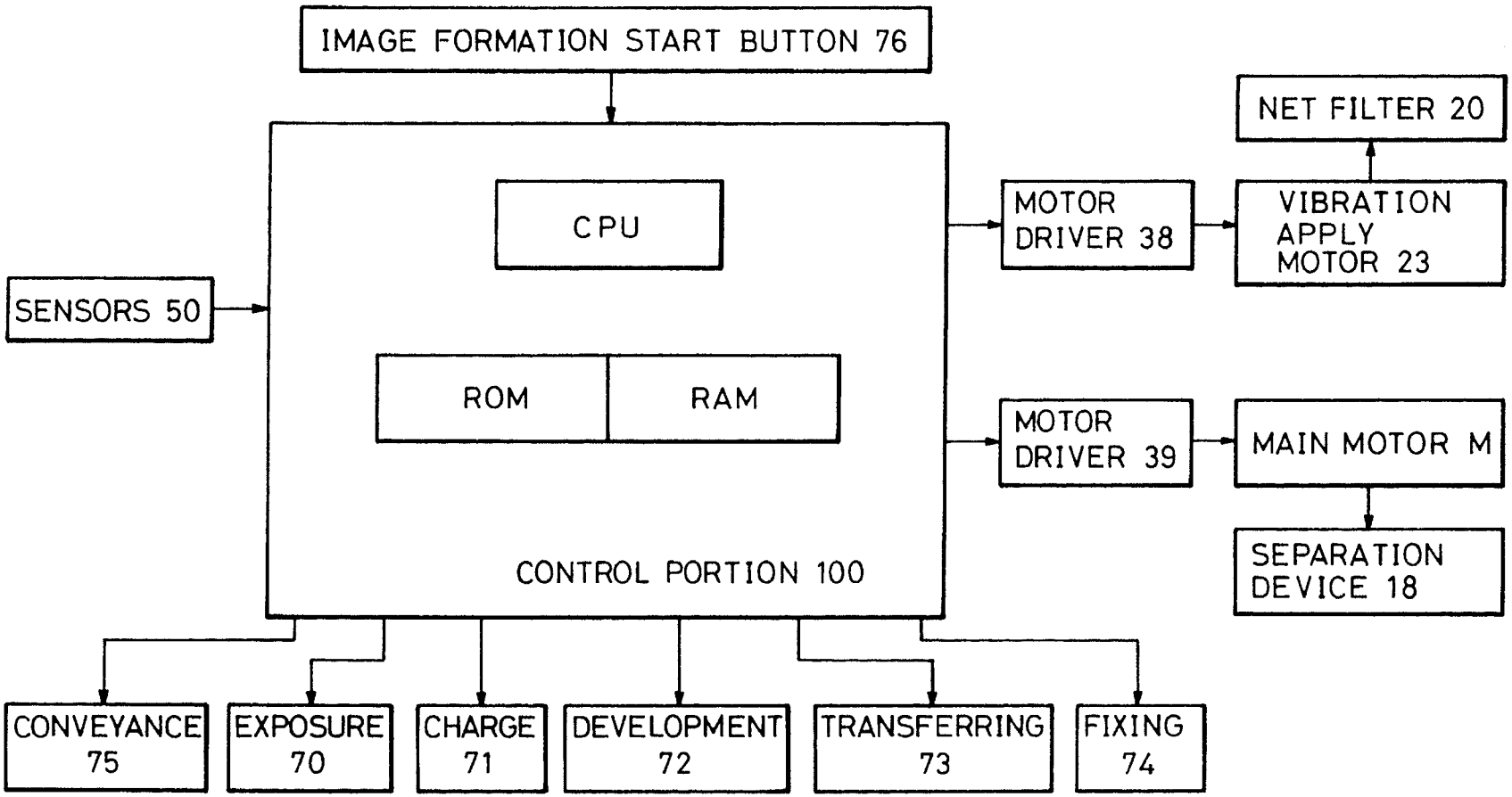
FIG. 11 is a block diagram showing a control process of the electrophotographic copying machine shown in FIG. 1.

Next, a control system for the image forming apparatus will be explained. In FIG. 11, a control portion 100 comprises a CPU, a ROM, a RAM and so on. The control portion 100 controls the drive motor 23 as the vibration applying means and the main motor M for driving the image forming apparatus via respective motor drivers 38, 39. The motors 23, M are controlled by the control portion 100 at preset timings. Incidentally, in the illustrated embodiment, the mesh filter 20 alone is vibrated by the drive motor 23, and the other portions of the separating apparatus and the entire image forming apparatus are driven by the main motor M.

When an image formation start button (not shown) is depressed by the operator, the main motor M and the drive motor 23 are driven synchronous with each other in response to a signal from the control portion 100. As a result, the above-mentioned image forming operation is performed. At the same time, the separating operation for separating the magnetic toner from foreign matter is effected by the mesh filter 20 and the sleeves 25, 26. When the image information is finished, the main motor M is stopped in response to a signal from the control portion 100. When a predetermined period of time (about 1 to 5 sec) is elapsed after the main motor M was stopped, the drive motor 23 is stopped. The collected toner which has already been conveyed to the separating zone X when the main motor M is stopped is pulled upwardly by the magnetic field generated by the sleeves 25, 26 (now stopped) opposed to each other with the interposition of the mesh filter 20. However, in the illustrated embodiment, as mentioned above, the drive motor 23 for vibrating the mesh filter 20 is controlled by the signal from the control portion 100 so that it is stopped when the predetermined period of time is elapsed after the main motor M was stopped. Thus, the mesh filter 20 is vibrated by the drive motor 23 driven for the above-mentioned predetermined period of time after the image formation, thereby separating the upwardly pulled toner or decomposing the aggregated toner lumps. Accordingly, in combination with the elimination of the concentrated magnetic field, the toner is not accumulated on the mesh filter 20 at the separating zone and, thus, filter jam does not occur due to aggregation of the toner even when the separating apparatus is left as it is for a long time.

The control portion 100 will be further explained below.

The control portion 100 serves to control the entire image forming apparatus and includes a CPU such as a microprocessor, a ROM for storing a control program for the CPU and various data, a RAM for temporarily storing various data and adapted to be used as a work area for the CPU, and so on. The control portion 100 receives signals from a group of sensors 50 including a sheet jam detection sensor (jam sensor). Further, the control portion 100 controls various processes such as an exposure process 70 (optical reading system 8), charge process 71 (charge means 7), development process 72 (developing device 2), transferring process 73 (transfer means 4) and fixing process 74 (fixing device 12), a conveyance system 75 (sheet supply portion 10, sheet re-supply portion 16), and the separating apparatus 18.

With the embodiments explained above, the magnetic pole $N_{26}$ of the magnet roller 26*a* is displaced or retracted by displacing or retracting means from the position where it is opposed to the magnetic pole $S_{25}$ of the magnet roller 25*a*, to thereby eliminate the concentrated magnetic field created by the magnetic poles $N_{26}$ and $S_{25}$. As a result, toner clinging to the mesh filter 20 is attracted by the magnetic force of the magnetic pole $S_{25}$ and is removed from the mesh filter 20.

Figure 10:
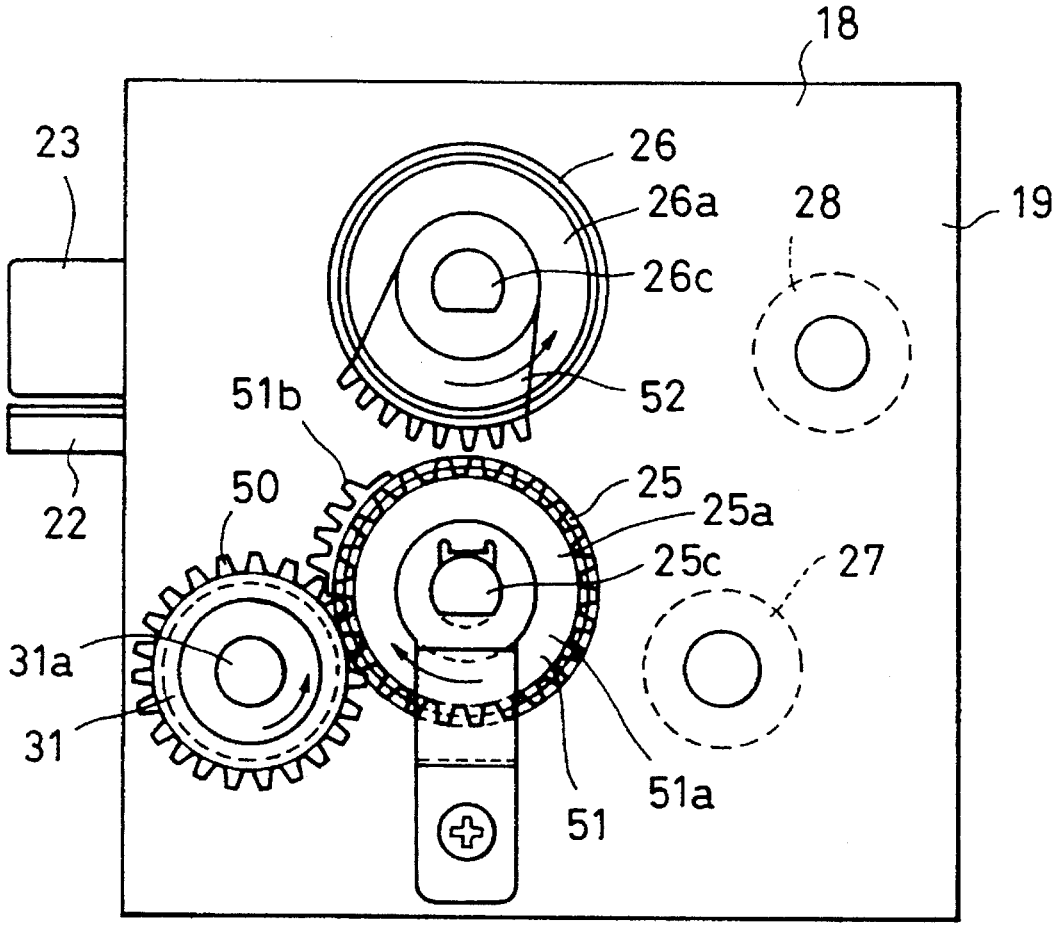
FIG. 10 is a side elevational view showing still another embodiment of the mechanism for eliminating the concentrated magnetic field.

With the embodiment illustrated in FIG. 10, the displacing means comprises the brush gear 50 attached to the shaft end 31*a* of the brush 31, the stepped relay gear 51, and the magnetic pole gear 52 attached to the end 26*c* of the shaft 26*b* supporting the magnet roller 26*a* (magnetic pole $N_{26}$). The brush gear 50 is held in mesh with the small-diameter gear 51*a* of the stepped relay gear 51, and the large-diameter gear 51*b* of the stepped relay gear 51 can be brought into mesh with the magnetic pole gear 52. When the shaft 26*b* of the magnet roller 26*a* is rotated by the driving force transmitted from the brush 31, the magnetic pole $N_{26}$ is displaced from the position where it is opposed to the magnetic pole $S_{25}$. In this embodiment, the brush 31 is rotated by the driving force transmitted from the main motor M of the image forming apparatus and, hence, the displacing means is operated by the driving force transmitted from the main motor M for displacing the magnetic pole $N_{26}$ from the position opposed to the magnetic pole $S_{25}$.

As explained above, according to the above embodiments since the magnetic force generating means is shifted at a proper timing to eliminate the concentrated magnetic field for removal of foreign matter accumulated on the mesh filter so far, foreign matter mixed in with used toner can be prevented from accumulating to such an extent as to cause a filter jam. It is thus possible to separate the foreign matter from the used toner for a long time in stable fashion with no need of maintenance. Consequently, the present invention is highly effective in improving the usage efficiency of the toner in the image forming apparatus and providing a high-quality image.

What is claimed is:

1. A separating apparatus for removing foreign matter from magnetic toner, said separating apparatus being used in an electrophotographic image forming apparatus, comprising:

a filter having openings for allowing passage of the magnetic toner:

a magnetic field generating means for generating magnetic field for attracting the magnetic toner and causing it to pass through said filter; and magnetic force decreasing means for decreasing a magnetic force generated by said magnetic field generating means to lessen the magnetic field for attracting the magnetic toner and causing it to pass through said filter.

2. A separating apparatus according to claim 1, wherein said magnetic field generating means comprises a second magnetic pole provided above said filter and a first magnetic pole provided below said filter, said second magnetic pole generating a magnetic force greater than that generated by said first magnetic pole, and wherein said magnetic force decreasing means has a displacing means for displacing said second magnetic pole from a position opposed to said first magnetic pole, so that when said second magnetic pole is displaced by said displacing means from the position opposed to said first magnetic pole, a concentrated magnetic field created by said second magnetic pole and said first magnetic pole is eliminated to remove the toner clinging to said filter by the magnetic force of said first magnetic pole.

3. A separating apparatus according to claim 2, further comprising a brush for removing deposits adhered to a circumferential surface of a sleeve incorporating said first magnetic pole, wherein said displacing means comprises a brush gear attached to a rotary shaft of said brush, a stepped relay gear, and a magnetic pole gear attached to a shaft supporting said second magnetic pole, said brush gear being meshed with a small-diameter gear of said stepped relay gear, a large-diameter gear of said stepped relay gear being meshed with said magnetic pole gear, the shaft supporting said second magnetic pole being rotated by a driving force for said brush to displace said second magnetic pole from the position opposed to said first magnetic pole.

4. A separating apparatus according to claim 3, wherein said brush is rotated by a driving force transmitted from a main motor of said electrophotographic image forming apparatus, and said displacing means displaces said second magnetic pole from the position opposed to said first magnetic pole by the driving force transmitted from said main motor.

5. A separating apparatus according to claim 2, wherein said displacing means includes a solenoid and rotates the shaft supporting said second magnetic pole by a driving force produced by said solenoid for displacing said second magnetic pole from the position opposed to said first magnetic pole.

6. A separating apparatus according to claim 5, wherein said solenoid is energized by an operator turning on a drive button.

7. A separating apparatus according to claim 5, wherein said solenoid is energized in response to an electric signal from a control portion.

8. A separating apparatus according to any one of claims 1, 2, 3 and 5, wherein said magnetic toner is one-component magnetic toner having an average particle diameter in the range of about 3.0 μm to 12.0 μm.

9. A separating apparatus according to claim 1, wherein the openings of said filter have a size in the range of about 37.5 μm to 150.0 μm.

10. An image forming apparatus for forming an image on a recording medium, comprising:

a) an electrophotographic photosensitive member;

b) image forming means for forming a toner image on said electrophotographic photosensitive member;

c) transfer means for transferring the toner image formed on said electrophotographic photosensitive member by said image forming means;

d) cleaning means for removing residual magnetic toner remaining on said electrophotographic photosensitive member therefrom, after the toner image has been transferred by said transfer means;

e) separating means for removing foreign matter from the magnetic toner removed from said electrophotographic photosensitive member by said cleaning means, said separating means comprising:

a filter having openings for allowing passage of the magnetic toner;

magnetic field generating means for generating a magnetic field for attracting the magnetic toner and causing it to pass through said filter; and magnetic force decreasing means for decreasing a magnetic force generated by said magnetic field generating means to lessen the magnetic field for attracting the magnetic toner and causing it to pass through said filter; and f) convey means for conveying said recording medium.

11. An image forming apparatus according to claim 10, wherein said magnetic field generating means comprises a second magnetic pole provided above said filter and a first magnetic pole provided below said filter, said second magnetic pole generating a magnetic force greater than that generated by said first magnetic pole, and wherein said magnetic force decreasing means includes a displacing means for displacing said second magnetic pole from a position opposed to said first magnetic pole, so that when said second magnetic pole is displaced by said displacing means from the position opposed to said first magnetic pole, a concentrated magnetic field created by said second magnetic pole and said first magnetic pole is eliminated to remove the toner clinging to said filter by the magnetic force of said first magnetic pole.

12. An image forming apparatus according to claim 11, further comprising a brush for removing deposits adhered to a circumferential surface of a sleeve incorporating said first magnetic pole, wherein said displacing means comprises a brush gear attached to a rotary shaft of said brush, a stepped relay gear, and a magnetic pole gear attached to a shaft supporting said second magnetic pole, said brush gear being meshed with a small-diameter gear of said stepped relay gear, a large-diameter gear of said stepped relay gear being meshed with said magnetic pole gear, the shaft supporting said second magnetic pole being rotated by a driving force for said brush to displace said second magnetic pole from the position opposed to said first magnetic pole.

13. An image forming apparatus according to claim 12, wherein said brush is rotated by a driving force transmitted from a main motor of said electrophotographic image forming apparatus, and said displacing means displaces said second magnetic pole from the position opposed to said first magnetic pole by the driving force transmitted from said main motor.

14. An image forming apparatus according to claim 11, wherein said displacing means includes a solenoid and rotates the shaft supporting said second magnetic pole by a driving force produced by said solenoid for displacing said second magnetic pole from the position opposed to said first magnetic pole.

15. An image forming apparatus according to claim 14, wherein said solenoid is energized by an operator turning on a drive button.

16. An image forming apparatus according to claim 14, wherein said solenoid is energized in response to an electric signal from a control portion.

17. An image forming apparatus according to any one of claims 10, 11, 12, and 14, wherein said magnetic toner is one-component magnetic toner having an average particle diameter in the range of about 3.0 μm to 12.0 μm.

18. An image forming apparatus according to claim 10, wherein the openings of said filter have a size in the range of about 37.5 μm to 150.0 μm.

19. A separating apparatus for removing foreign matter from magnetic toner, said separating apparatus being used in an electrophotographic image forming apparatus, comprising:

a filter having openings for allowing passage of the magnetic toner;

a first roller having a first magnetic pole arranged therein and conveying the magnetic toner to a position opposed to said filter;

a second roller arranged in opposition to said first roller with the interposition of said filter and having a second magnetic pole arranged therein to generate a magnetic force greater than that generated by said first magnetic pole, for attracting the magnetic toner adhered to a circumferential surface of said first roller and causing it to pass through said filter; and magnetic pole retracting means for retracting said second magnetic pole from the position opposed to said first magnetic pole to decrease the magnetic force for attracting the magnetic toner and causing it to pass through said filter, so that when said second magnetic pole is retracted from the position opposed to said first magnetic pole, the magnetic toner clinging to said filter is attracted by the magnetic force of said first magnetic pole toward said first roller and is removed from said filter.

20. A separating apparatus according to claim 19, further comprising a brush for removing the magnetic toner adhered to the circumferential surface of said first roller, wherein said magnetic pole retracting means comprises a brush gear attached to a rotary shaft of said brush, a stepped relay gear, and a magnetic pole gear attached to a shaft supporting said second magnetic pole, said brush gear being meshed with a small-diameter gear of said stepped relay gear, a large-diameter gear of said stepped relay gear being meshed with said magnetic pole gear, the shaft supporting said second magnetic pole being rotated by a driving force for said brush to displace said second magnetic pole from the position opposed to said first magnetic pole.

21. A separating apparatus according to claim 20, wherein said brush is rotated by a driving force transmitted from a main motor of said electrophotographic image forming apparatus, and said magnetic pole retracting means displaces said second magnetic pole from the position opposed to said first magnetic pole by the driving force transmitted from said main motor.

22. A separating apparatus according to claim 20, wherein said magnetic pole retracting means includes a solenoid and rotates the shaft supporting said second magnetic pole by a driving force produced by said solenoid for displacing said second magnetic pole from the position opposed to said first magnetic pole.

23. A separating apparatus according to claim 22, wherein said solenoid is energized by an operator turning on a drive button.

24. A separating apparatus according to claim 22, wherein said solenoid is energized in response to an electric signal from a control portion.

25. A separating apparatus according to any one of claims 19, 20, 21 and 23, wherein said magnetic toner is one-component magnetic toner having an average particle diameter in the range of about 3.0 μm to 12.0 μm.

26. A separating apparatus according to claim 1, wherein the openings of said filter have a size in the range of about 37.5 μm to 150.0 μm.

27. An image forming apparatus for forming an image on a recording medium, comprising:

a) an electrophotographic photosensitive member;

b) image forming means for forming a toner image on said electrophotographic photosensitive member;

c) transfer means for transferring the toner image formed on said electrophotographic photosensitive member by said image forming means;

d) cleaning means for removing residual magnetic toner remaining on said electrophotographic photosensitive member therefrom, after the toner image has ben transferred by said transfer means;

e) separating means for removing foreign matter from the magnetic toner removed from said electrophotographic photosensitive member by said cleaning means, said separating means comprising:

a filter having openings for allowing passage of the magnetic toner;

a first roller having a first magnetic pole arranged therein and conveying the magnetic toner to a position opposed to said filter;

a second roller arranged in opposition to said first roller with the interposition of said filter and having a second magnetic pole arranged therein to generate a magnetic force greater than that generated by said first magnetic pole, for attracting the magnetic toner adhered to a circumferential surface of said first roller and causing it to pass through said filter; and magnetic pole retracting means for retracting said second magnetic pole from the position opposed to said first magnetic pole to decrease the magnetic force for attracting the magnetic toner and causing it to pass through said filter, so that when said second magnetic pole is retracted from the position opposed to said first magnetic pole, the magnetic toner clinging to said filter is attracted by the magnetic force of said first magnetic pole toward said first roller and is removed from said filter; and f) convey means for conveying said recording medium.

28. An image forming apparatus according to claim 27, further comprising a brush for removing the magnetic toner deposits adhered to the circumferential surface of said first roller, wherein said magnetic pole retracting means comprises a brush gear attached to a rotary shaft of said brush, a stepped relay gear, and a magnetic pole gear attached to a shaft supporting said second magnetic pole, said brush gear being meshed with a small-diameter gear of said stepped relay gear, a large-diameter gear of said stepped relay gear being meshed with said magnetic pole gear, the shaft supporting said second magnetic pole being rotated by a driving force for said brush to displace said second magnetic pole from the position opposed to said first magnetic pole.

29. An image forming apparatus according to claim 28, wherein said brush is rotated by a driving force transmitted from a main motor of said electrophotographic image forming apparatus, and said magnetic pole retracting means displaces said second magnetic pole from the position opposed to said first magnetic pole by the driving force transmitted from said main motor.

30. An image forming apparatus according to claim 27, wherein said magnetic pole retracting means includes a solenoid and rotates the shaft supporting said second magnetic pole by a driving force produced by said solenoid for displacing said second magnetic pole from the position opposed to said first magnetic pole.

31. An image forming apparatus according to claim 30, wherein said solenoid is energized by an operator turning on a drive button.

32. An image forming apparatus according to claim 30, wherein said solenoid is energized in response to an electric signal from a control portion.

33. An image forming apparatus according to any one of claims 27, 28, 29, and 31, wherein said magnetic toner is one-component magnetic toner having an average particle diameter in the range of about 3.0 μm to 12.0 μm.

34. An image forming apparatus according to claim 27, wherein the openings of said filter have a size in the range of about 37.5 μm to 150.0 μm.

35. A separating apparatus according to claim 8, wherein the openings of said filter have a size in the range of about 37.5 μm to 150.0 μm.

36. An image forming apparatus according to claim 17, wherein the openings of said filter have a size in the range of about 37.5 μm to 150.0 μm.

37. A separating apparatus according to claim 25, wherein the openings of said filter have a size in the range of about 37.5 μm to 150.0 μm.

38. An image forming apparatus according to claim 33, wherein the openings of said filter have a size in the range of about 37.5 μm to 150.0 μm.

* * * * *

UNITED STATES PATENT AND TRADEMARK OFFICE

CERTIFICATE OF CORRECTION

PATENT NO. : 5,532,800 Page 1 of 3

DATED : July 2, 1996

INVENTOR(S) : Hironobu SAITO

It is certified that error appears in the above-indentified patent and that said Letters Patent is hereby corrected as shown below:

COLUMN 1:

Line 9, "to" should be deleted;
Line 22, "trophotograph" should read --trophotographic--;
Line 39, "patent" should read --Patent--; and,
Line 47, "provide" should read --provide a--.

COLUMN 2:

Line 15, "FIG. 1" should read --FIG. 1 is--; and,
Line 19, "FIG. 2" should read --FIG. 2 is--.

COLUMN 3:

Line 31, "the" (first occurrence) should read --the original--; and
Line 35, "8d," should read --8d, and--.

COLUMN 4:

Line 18, "the" (first occurrence) should read --used--.

UNITED STATES PATENT AND TRADEMARK OFFICE

CERTIFICATE OF CORRECTION

PATENT NO. : 5,532,800 Page 2 of 3

DATED : July 2, 1996

INVENTOR(S) : Hironobu SAITO

It is certified that error appears in the above-indentified patent and that said Letters Patent is hereby corrected as shown below:

COLUMN 5:

Line 22, "On other hand, the" should read --On the other hand,--.

COLUMN 6:

Line 8, "the" should be deleted; and,
Line 26, "sen" should read --sent--.

COLUMN 7:

Line 2, "non-used" should be deleted; and,
Line 31, "matter" should read --matters--.

COLUMN 8:

Line 6, "the" (last occurrence) should be deleted;
Line 7, "magnet" should read --magnetic--; and,
Line 31, "since" should be deleted.

COLUMN 9:

Line 26, "matter" should read --matters--; and,
Line 45, "the" (first occurrence) should be deleted.

UNITED STATES PATENT AND TRADEMARK OFFICE

CERTIFICATE OF CORRECTION

PATENT NO. : 5,532,800 Page 3 of 3

DATED : July 2, 1996

INVENTOR(S) : Hironobu SAITO

It is certified that error appears in the above-indentified patent and that said Letters Patent is hereby corrected as shown below:

COLUMN 10:

Line 62, "other;" should read --other,--.

COLUMN 11:

Line 5, "the" should be deleted; and,
Line 48, "roller 25" should read --roller 25a--.

COLUMN 14:

Line 43, "with" should read --with the--;
Line 57, "toner:" should read --toner;--; and,
Line 58, "a" should be deleted and "generating" should read --generating a--.

COLUMN 17:

Line 62, "claim 1," should read --claim 19,--.

COLUMN 18:

Line 8, "ben" should read --been--.

Signed and Sealed this

Twenty-ninth Day of April, 1997

Bruce Lehman

*Attest:*

BRUCE LEHMAN

*Attesting Officer*

*Commissioner of Patents and Trademarks*